United States Patent [19]

Matsuda et al.

[11] 3,959,027

[45] May 25, 1976

[54] METHOD OF MANUFACTURING ALUMINUM ALLOY ELECTRIC CONDUCTORS

[75] Inventors: Yoshio Matsuda; Minoru Yokota; Yoshie Hanaki, all of Osaka; Megumu Sumitomo, Nagoya, all of Japan

[73] Assignee: Sumitomo Electric Industries, Ltd., Osaka, Japan

[22] Filed: Nov. 23, 1973

[21] Appl. No.: 418,188

Related U.S. Application Data

[62] Division of Ser. No. 210,646, Dec. 22, 1971, abandoned.

[52] U.S. Cl. ..... 148/2; 75/147; 148/11.5 A; 148/32

[51] Int. Cl.[2] ..... C22F 1/04

[58] Field of Search ..... 148/2, 11.5 A, 32, 32.5; 75/147

[56] References Cited

UNITED STATES PATENTS 2,572,562 10/1951 Harrington ..... 75/147

*Primary Examiner*—R. Dean

*Attorney, Agent, or Firm*—Carothers and Carothers

[57] ABSTRACT

An aluminum alloy for electric conductors having a conductivity of not less than 60% IACS, which is further highly strong and ductile yet eligible for conventional highspeed tandem manufacturing using a continuous annealing treatment. The aluminum alloy comprises approximately 0.05–0.25 wt-% magnesium, 0.05–0.25 wt-% silicon, 0.0005–0.3 wt-% beryllium, and a balance of aluminum with a requisite relationship between the magnesium and silicon content of $Mg + Si \leqq 0.30$ wt-%.

1 Claim, 2 Drawing Figures

METHOD OF MANUFACTURING ALUMINUM ALLOY ELECTRIC CONDUCTORS

This application is a division of application Ser. No. 210,646 filed Dec. 22, 1971, now abandoned.

BACKGROUND OF THE INVENTION

This invention relates generally to aluminum alloys and more particularly to aluminum alloy conductors.

Heretofore copper wires have been used as the electromagnetic conductors in transformers, motors, etc., conductors for communication cables and conductors for indoor wire exclusively. In more recent times, however, the rise and fluctuation of the price of copper throughout the world has accelerated the desire for the substitution of copper with aluminum as a material for conductors. This substitution is made even more desirous with the increase in need to make electric machines and appliances, cables, etc. lighter. These conditions have quickly called forth brisk activities in an endeavor to use aluminum and aluminum alloy wires for such conductors. Under the circumstances, aluminum alloy wires used for these purposes have come to be required to possess properties similar to those of copper wires heretofore in use. The properties required of such conductors are as follows:

1. As conductors, they are required to have a high electric conductivity, which must not be lower than 60% IACS.
2. As for mechanical properties, they must possess qualities of flexibility suitable for electric wires, ductility and flexibility sufficient to withstand the bending at the time of manufacture and use, and some degree of strength which will withstand the required tension applied thereto at the time of use and manufacture.
3. The manufacturing processes of conductors for coils, conductors for communication cables, conductors for indoor wires, etc. must not be interrupted by batch annealing or the like because the manufacture of electric wires using such conductors is usually carried out in a high speed tandem line of drawing, continuous annealing and insulation sheathing. It is therefore necessary that the heat treatment for obtaining satisfactory properties be done by a continuous process, dispensing with such complicated treatments as quenching, aging, etc.

Heretofore, aluminum for electric purposes, Al-Mg alloys (for example, Alloy 5005) which are called alloys of the work hardening type, Al-Mg-Si alloys (for example, "Aldrey" Aluminum Alloy, Alloy 6201) which are called alloys of the age-hardening type, etc., have been used for transmission lines and distribution lines in the form of an aluminum conductor steel reinforced (known as ACSR), an all aluminum conductor (AAC), an all aluminum alloy conductor (AAAC), an aluminum conductor aluminum alloy reinforced (ACAR), etc. All of these are put to use after cold working, or after such heat treatments as quenching and aging treatment. In spite of their high mechanical strength, they have a very low electric conductivity (52 – 55% IACS), with the exception of electric conductor grade aluminum (electric conductivity 52 – 55% IACS).

The present inventors gave suitable annealing treatments to such alloys with a view toward obtaining a material which has a proper degree of strength. However, the materials thus obtained were not good for the intended purpose because their electric conductivity was as low as 57 – 59% IACS, although they were satisfactory with respect to strength and ductility.

On the other hand, the soft material of electric conductor grade aluminum was found unsatisfactory with respect to strength, its strength being as markedly low as approximately 8 – 9 Kg/cm$^2$. Furthermore, even when the cold working treatment of 10-odd percent after annealing, which is a technique generally employed in the manufacture of one quarter hard materials, was given, the tensile strength was improved only to about 11 Kg/mm$^2$ and was found insufficient for use in many instances. If the degree of cold working is increased further, ductility reduces considerably.

There is on the other hand, an aluminum alloy for electric conductors, that is a soft material which is an Al-Fe-Mg-Si alloy developed for use as rotors in rotary machines and is commonly called Cond aluminum alloy. It is recommended as having excellent resistance to creep. (See for example, U.S. Pat. No. 2,572,562) This alloy is of the age-hardening type, the precipitation-phase of $Mg_2Si$ being a strengthening factor, and contains 0.2 – 1.1 percent Fe, 0.2 – 0.5 percent Mg and 0.05 – 0.15 percent Si. A conductor which is comparatively excellent in strength, electric conductivity and ductility is obtained by adding comparatively large quantities of Mg, Fe and Si, applying heat treatment for a long time at a high temperature of 400°C - 450°C, and then cold working the alloy to an extent of about 10%. However, the necessity of giving heat treatment for a long time at a high temperature becomes a fatal drawback when manufacturing the afore-mentioned magnet wires and conductors for communication cables and indoor wires. That is to say, materials such as this which are not usable in tandem line production make the production cost very high.

SUMMARY OF THE INVENTION

This invention provides an aluminum alloy devoid of the aforementioned disadvantages consisting of 0.05 – 0.25 percent (on the basis of weight: hereinafter all percentages are on the basis of weight) magnesium, 0.05 – 0.25 percent silicon, 0.0005 – 0.3 percent beryllium and the balance aluminum. The relationship between the quantities of magnesium and silicon is Mg + Si $\leqq$ 0.30%. This invention provides an aluminum alloy for electric conductors which is capable of being finished into electric conductors by melting, casting, hot working, cold working, heat treatment, etc. for uses similar to those of ordinary aluminum alloy conductors. The aluminum alloy of the present invention further satisfies the requirement of an electric conductivity which is not less than 60% IACS, and which is excellent with respect to strength and ductility, after a continuous annealing process as may be carried out on a high speed tandem manufacturing line for electric cables.

The present inventors have discovered that the requirement of 60% IACS conductivity, which is of paramount importance for materials to be applied to the afore-mentioned uses, can be satisfied while still retaining the desired mechanical strength by greatly decreasing the contents of magnesium and silicon in the conventional Al-Mg-Si alloy and adding thereto a very small quantity of beryllium.

This invention provides an aluminum alloy for electric conductors which has properties best-suited for use as conductors for magnet wires, conductors for communication cables and conductors for indoor wires, etc.

DETAILED DESCRIPTION OF THE INVENTION

Figures 1, 2:
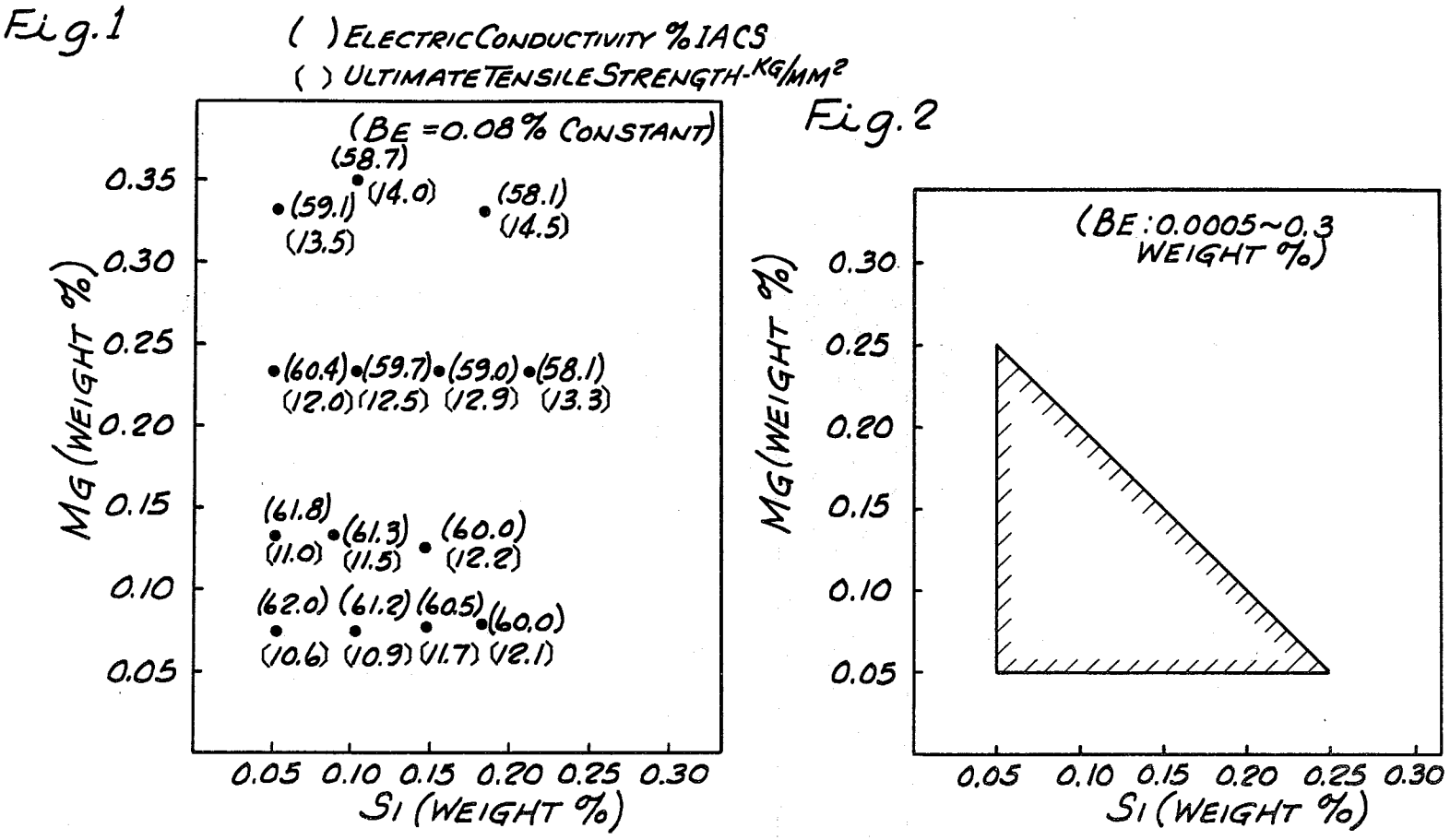
FIG. 1 is a chart showing the relationship between the magnesium and silicon contents and properties.
FIG. 2 is a diagram showing the scope of composition for the aluminum alloys according to the present invention.

This invention provides an aluminum alloy which can satisfy the most important requirements of such magnet wires and conductors for communication cables and indoor wires and which can yet retain the desired mechanical strength, by remarkably decreasing the contents of magnesium and silicon in the conventional Al-Mg-Si alloy and adding a very small quantity of beryllium.

There have been already several instances where either magnesium, silicon or beryllium (or some combination thereof) was combined with aluminum and the recrystallization behavior, work-hardening property, crystalline grain size and electric conductivity, etc. of the product were investigated and reported. In all of these instances, however, the castings and age-hardening properties were of primary concern. There has been no report in which such overall properties as electric conductivity, ductility and mechanical strength of the annealed or one quarter hardened material by continuous annealing methods were discussed.

This invention pertains to an aluminum alloy for electric conductors which is characterized in that it is an alloy consisting of 0.05 – 0.25% magnesium, 0.05 – 0.25% silicon, 0.0005 – 0.3% beryllium and the balance aluminum, and with the additional relationship of $Mg + Si \leqq 0.30\%$ existing between the quantities of magnesium and silicon contained therein.

The alloy of this invention provides an aluminum alloy for electric conductors, by continuous annealing methods, which satisfies the requirements for electric conductivity of 60% IACS or more and which in addition has excellent strength and ductility. The reason why the magnesium content is specified here to be approximately 0.05 – 0.25% is that if it is 0.04% or less, it has little effect in improving the strength, and if it is 0.26% or more, the electric conductivity reduces to below 60% IACS after continuous annealing treatment.

The reason the minimum silicon content is specified to be approximately 0.05% is that the usual electric conductor grade aluminum contains a minimum of about 0.05% silicon. The reason why the maximum content is specified to be approximately 0.25% is to prevent lowering of the electric conductivity below 60% IACS by continuous annealing treatment. The reason a relationship of $Mg + Si \leqq 0.30\%$ between the magnesium and silicon contents is required is to fullfill the requirement of an electric conductivity of 60% IACS or more at all times and to take full advantage of the excellent ductility of Al-Mg-Si alloys.

The beryllium content is specified to be approximately 0.0005% – 0.3% because if it is less than 0.0005%, it is not found effective in improving ductility and electric conductivity, while if it is 0.31% or more, it can improve ductility but affects electric conductivity detrimentally and is also found disadvantageous from the viewpoint of cost.

It is quite permissible if the afore-mentioned aluminum alloy contains such impurities as Cu, Mn, V, Ti, B, etc. which are contained in the usual aluminum used for electric purposes. It is also quite permissible, if Fe, which is widely known as an element to make the crystalline grain size smaller, or Sb, which is known as an element which improves the corrosion-resistance of aluminum, or the like is intentionally added in so far as it effects the requirement for electric conductivity of 60% IACS or more as this will remain satisfied. However, the general techniques employed in manufacturing aluminum for electric purposes, such as the settling of Ti, V, etc. which are especially harmful to electric conductivity by boron treatment at the time of casting, should be carried out without fail.

The alloy of this invention will now be explained in detail, with reference to an example of experiment.

Example of Experiment:

Various alloys were melted and cast into wire bars (150 mm × 150 mm) using Al-10% Mg mother alloy, Al-10% Si mother alloy and Al-5% Be mother alloy with ordinary electric conductor grade aluminum. Wire rods of a diameter of 12 mm were obtained by hot working after casting. Then, without giving them the intermediate heat treatment, the rods were cold drawn down to a diameter of 0.51 mm. At this diameter of 0.51 mm, the wires were made soft by an electric continuous annealing treatment at a line speed of 1,000 m/minute. The continuous annealing treatment in this case was of the resistance heating technique using a graphite sieve, charge span of 1,500 mm, a voltage of approximately 50 V and an electric current of approximately 70 A. Generally speaking, in the case of Al-Mg-Si alloys, if the degree of softening is increased by the continuous annealing treatment, the electric conductivity becomes lower. Consequently, measures toward the maintenance of a high electric conductivity, such as an intermediate annealing, are considered. However, the stability at the time of mass production has become a problem. The object of this invention is to provide an aluminum alloy which satisfies the requirement of an electric conductivity of 60% IACS or more at all times and which can be produced in large quantities without delicate adjusting of the degree of softening.

We have, accordingly, made soft materials by continuous annealing treatment and measured their mechanical and electrical properties.

FIG. 1 shows the results of the measurement of electric conductivity (% IACS - in parentheses in the Figure) and tensile strength ($Kg/cm^2$ - in brackets in the Figure) after continuous annealing of Al-Mg-Si-Be alloys, with a constant Be content of 0.08% and varying the Mg and Si contents. The elongation varied somewhat, depending on the constitution, but generally had a value of 15% – 25% (gauge length 250 mm). Compared with the materials containing no beryllium, they retain an electric conductivity which is higher by about 0.5% IACS. It has further been found that in addition, the elongation of the soft material has a value several % higher and that the addition of a very small quantity of beryllium improves electric conductivity and ductility. For instance, the specimen having 0.09% Si and 0.13% Mg, had an electric conductivity of 61.3% IACS, tensile strength of 11.5 $Kg/mm^2$ and elongation of 23.5% when 0.08% Be had been added. Without the addition of Be, the specimen had an electric conductivity of 60.9% IACS, tensile strength of 11.4 $Kg/mm^2$ and elongation of 18.5%. About 0.08% is the optimum quantity of Be that should be included. When it was 0.31% or more, the electric conductivity definitely showed a decrease.

The results of linear approximation from FIG. 1 of the Mg and Si contents which satisfy the requirement of an electric conductivity of 60% IACS or more are given in FIG. 2. That is to say, compositions within the hatched area of FIG. 2 possess a stabilized electric conductivity of not less than 60% IACS and can provide an aluminum alloy having improved strength and ductility for electric purposes. The area shows the scope of compositions according to this invention.

As has been described, this invention provides an aluminum alloy which possesses the requisite property of an electric conductivity of not less than 60% IACS, and which is eligible for a high speed tandem manufacturing line involving such modernized processes as the electric continuous annealing treatment, the manufacturing processes required being quite similar to those for electric conductor grade aluminum wires. As a material for aluminum alloy conductors such as magnet wire, conductors for communication cables and conductors for indoor wires, etc. which are required to possess overall satisfactory properties of electric conductivity and ductility, therefore, it has a great value for industrial applications.

We claim:

1. The method of manufacturing an aluminum alloy electric conductor comprising the steps of mixing an alloy consisting essentially of approximately 0.05–0.25 wt-% magnesium, 0.05–0.25 wt-% silicon, 0.0005–0.3 wt-% beryllium, with a balance of aluminum under the additional conditions that the magnesium and silicon content satisfy the relationship of $Mg + Si \leqq 0.30$ wt-%, melting the mixture, casting the melted mixture, hot rolling the metal casting, cold drawing the rolled casting into an electric conductor, and applying a continuous annealing treatment to the cold drawn conductor.

* * * * *